United States Patent [19]

Schlemon

[11] 4,303,183

[45] Dec. 1, 1981

[54] GARMENT PRESSER

[76] Inventor: George Schlemon, 3060 Pharr Ct. NW., Atlanta, Ga. 30305

[21] Appl. No.: 115,100

[22] Filed: Jan. 24, 1980

[51] Int. Cl.[3] ..... D06F 71/18; D06F 71/40

[52] U.S. Cl. ..... 223/67; 223/70

[58] Field of Search ..... 223/67, 70; 38/70

[56] References Cited

U.S. PATENT DOCUMENTS

| | | | |
|---|---|---|---|
| 2,425,194 | 8/1947 | Lendle | 223/70 |
| 2,459,962 | 1/1949 | Richa et al. | 223/70 X |
| 2,513,427 | 7/1950 | Richa et al. | 223/70 X |
| 2,543,413 | 2/1951 | Koth | 223/70 X |
| 3,286,889 | 11/1966 | Schlemon | 223/70 |

*Primary Examiner*—Louis Rimrodt

*Attorney, Agent, or Firm*—Jones, Thomas & Askew

[57] ABSTRACT

The garment presser bag assembly includes an inner bag of woven nylon material open at its lower end and defining at its upper end neck and arm openings. An outer bag of net-like material also includes an open lower end and neck and arm openings at its upper end, with the two bags being connected together about their respective neck and arm openings, leaving the lower end of the outer bag movable with respect to the inner bag. An expandable ring element is movable along the length of the outer bag so as to constrict the expansion of the bags when inflated.

10 Claims, 6 Drawing Figures

GARMENT PRESSER

FIELD OF INVENTION

This invention relates to inflatable garment presser bags which are draped on a support and expanded by steam and air under pressure, so that a garment draped thereon, such as jackets, shirts, dresses, etc. are expanded and treated with steam and hot drying air to remove wrinkles from the garment.

BACKGROUND OF THE INVENTION

In the cleaning and pressing of garments, the garments are placed on inflatable bag structures after the garments have been cleaned in order to remove the wrinkles from the garments and to shape the garments. The expandable bag structures usually are mounted on a supporting framework which is rotatable about an upright axis, and one or more clamp elements are movable toward and away from the framework to engage the garment and hold the coat tails, lapels, etc. of the garment in place during the period when the inflatable presser bag and garment are being expanded treated by the steam and hot air.

Some of the problems involved in the use of the prior art garment presser bar arrangements are that the steam and hot air used to inflate the bags and treat the garments on the expanded bag tend to escape from the bag in those areas not contacted by the garment draped on the bag, thus wasting energy and reducing the effectiveness of the procedure, and the garment bags are somewhat uncontrollable in that they tend to over inflate and stretch portions of the garment draped thereon, causing wrinkles in the garment, especially about the lower edge of the garment.

In order to avoid over inflation of the garments, the prior art inflatable bag structures were made in different sizes and shapes, small bags being usable for the smaller garments and large bags being usable for the larger garments. Of course, this required several bag structures and supporting framework to be available, and usually resulted in the worker using only a single bag structure of a particular size on a single framework to treat garments of all sizes, and many garments were either over expanded or under expanded in the process.

In order to solve the problem of improper expansion of the garments, various adjustable bag structures were developed. Some bags include zippers placed in the bag which could be selectively opened and closed to adjust the size of the garment presser bag, and another attempted solution included the connection of draw strings to inside areas of the presser bag that could be manipulated from outside the bag to expand and contract the bag. Another attempted solution was to use a non-inflatable bag that controlled the flow of steam and hot air to some extent, but which did not expand the garment placed on the bag structure. A further attempted solution was the use of a double bag structure, with an outer bag connected at its lower end to the lower end of the inner bag, with an elastic band in the upper end of the outer bag that could be moved up and down the inner bag. The double bag structure helped to control the over expansion of the inner bag and the garment and also constricted the flow of fluid through the lower portion of the inner bag.

While some of the prior art garment presser bag assemblies can be manipulated to some extent to control over expansion of the presser bag and of the garment, the workers that use the garment presser bag assemblies are likely to ignore some of the control features because of the inconvenience and difficulty in manipulating the control features. Also, some of the control features wear out or otherwise become inoperable during the use of the presser bag, and the garment presser bag assembly continues to be used after the control features are unusable, causing improper expansion, wrinkling and stretching of the garments.

SUMMARY OF THE INVENTION

Briefly described, the present invention comprises a garment presser bag assembly for treating and "pressing" garments wherein the presser bag is inflated and the garment draped thereon is expanded and permeated with steam and hot air under pressure so as to remove the wrinkles from the garment and to shape the garment. The garment presser bag assembly is mounted on a conventional supporting framework and comprises an inner bag of woven nylon or the like connected at its lower open end to the framework and defines neck and arm openings at its upper end. An outer bag of net-like material which also defines neck and arm openings at its upper end is placed over the inner bag and the two bags are connected together about their respective neck and arm openings. The outer bag is shorter than the inner bag and its lower open end is movable along the length of the inner bag, and the inner bag is of greater breadth than the outer bag so that when the inner bag is inflated with steam or hot air the inner bag expands outwardly into engagement with the outer bag and the lower portion of the outer bag can ride up the inner bag as they are expanded. The net-like material of the outer bag prevents the inner bag from forming a seal between the inner bag and the garment placed thereon.

An expandable restraining ring is placed about the outer bag, usually just below the lower end of the garment placed about the outer bag, so as to control the expansion of the garment presser bag assembly and to prevent the garment from being over expanded at its lower edge.

Thus, it is an object of this invention to provide a garment presser which is convenient for the operator to use and which functions to expand and to permeate garments with steam and hot air to shape the garments and to remove wrinkles therefrom, substantially without hazard of overexpanding and wrinkling the garments.

Another object of this invention is to provide a garment presser bag assembly which is inflatable to expand a garment draped thereon without blocking the flow of steam or air to and through the garment.

Another object of this invention is to provide a garment presser bag assembly for use with a supporting framework of a garment presser, which is inexpensive to manufacture, which is effective in the "pressing" and shaping of garments, and which is durable and convenient for the operator to use.

Other objects, features and advantages of the present invention will become apparent upon reading the following specification, when taken in conjunction with the accompanying drawings.

DETAILED DESCRIPTION

Figure 1:
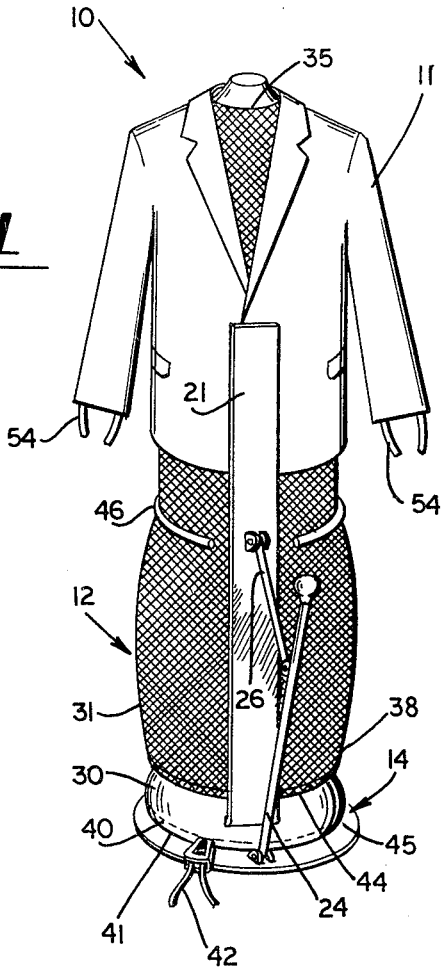
FIG. 1 is a perspective view of the garment presser bag assembly mounted on a supporting framework, showing a garment mounted thereabout.
Figure 2:
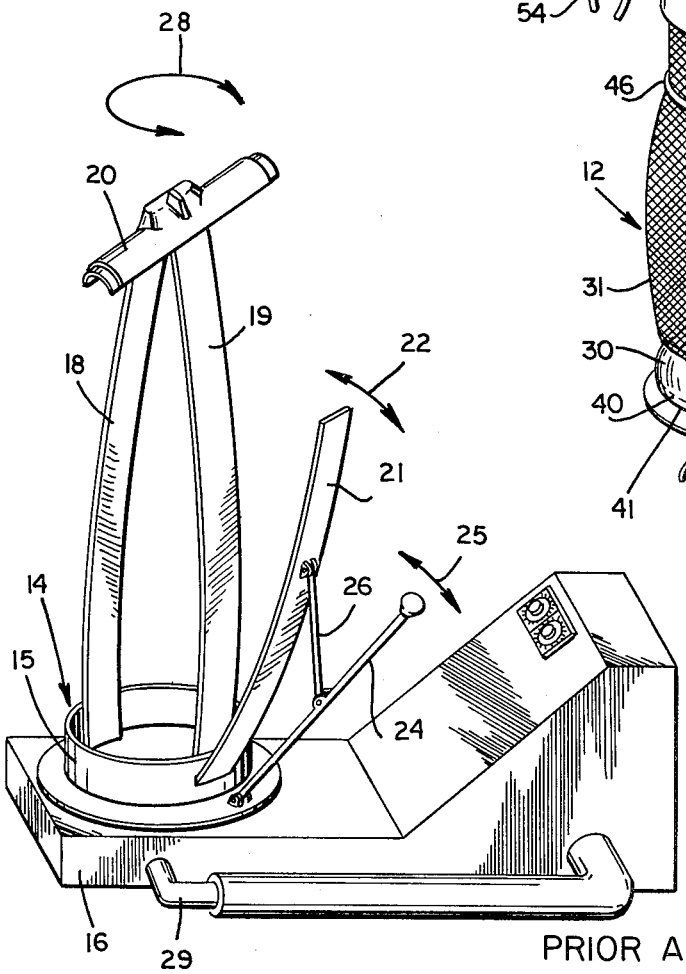
PRIOR ART Fig. 2
FIG. 2 is a perspective illustration of the prior art supporting framework on which the garment presser bag assembly is mounted.
Figure 3:
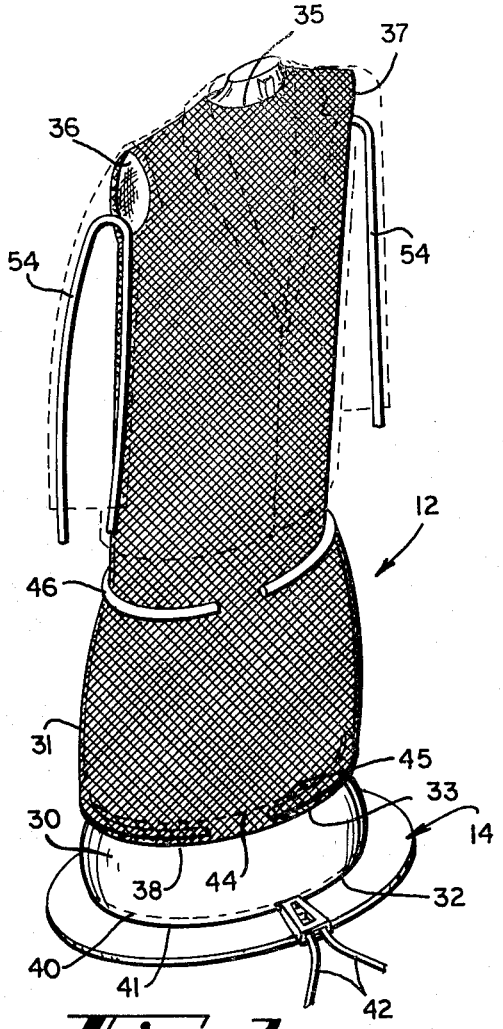
FIG. 3 is a perspective illustration of the garment presser bag assembly and support framework, with the garment draped thereon shown in dash lines.

Referring now in more detail to the drawings, in which like numerals indicate like parts throughout the several views, FIG. 1 illustrates a garment presser 10 with a garment 11 draped thereon. The garment presser includes a garment presser bag assembly 12 mounted on a supporting framework 14. As illustrated in FIG. 2, the supporting framework 14 includes a turntable 15 rotatabe about an upright axis on support structure 16 and upwardly extending supports 18 and 19. A shoulder or yoke structure 20 is mounted on the upper ends of the upwardly extending supports 18 and 19. Clamp element 21 is pivotally connected at its lower end to turntable 15 and is movable as indicated by double headed arrow 22 toward and away from upwardly extending support 19. Control rod 24 is pivotable as indicated by its double headed arrow 25 about its lower end, and connecting rod 26 is connected at its ends between control rod 24 and clamp 21. The entire supporting framework 14 is pivotable about an upright axis as indicated by double headed arrow 28. Conduit 29 communicates at one of its ends with the interior of the supporting framework 14 and at its other end with a heating element, so that hot air and steam can be directed through conduit 29 into the interior area of the supporting framework 14 so as to inflate and expand the garment presser bag assembly 12. The structure illustrated in FIG. 2 is part of the prior art.

Garment presser bag assembly 12 comprises inner bag 30 and outer bag 31. Both bags are formed with open lower ends 32 and 33, respectively, and both bags include at their upper ends a centrally positioned neck opening 35 and arm openings 36 and 37. The bags are connected together about their respective neck and arm openings 35–37, as by sewing a hem structure about the openings, and the lower end 38 of the outer bag 31 is movable along the height of the inner bag 30. The garment presser bag assembly 12 is mounted on the supporting framework 14, with the shoulder structure 20 of the framework supporting the upper end of the bag assembly and protruding through the neck and arm openings of the bag assembly. A hem 40 is formed about the lower end 41 of the inner bag, and a drawstring 42 is threaded through the hem. The drawstring is tightened about the upper flange of the turntable 15 so as to form a seal between the inner bag 30 and the turntable.

A hem 44 is formed at the lower end 38 of the outer bag 31, and an expandable ring or stay 45 is inserted in the hem. Expandable ring 45 comprises a C-shaped resilient metal rod inserted in a tubular nylon sheath, with the sheath being closed at its opposite ends to seal the metal rod and from moisture, etc. The expandable ring 45, when not expanded, is of a circumference less than the circumference of outer bag 31. A similar expandable ring 46 is placed about the outer bag 31 and its movable along the length of the outer bag by the operator grasping a portion of the ring and lifting or lowering the ring.

When the bag assembly 12 has been expanded due to inflation and is subsequently contracted by deflation, the ends 48 of the expandable ring 46 tend to move toward abutment with each other, and the span of material of the outer bag 31 that was between the ends 48 of the expandable ring 46 tends to become trapped between the ends of the ring. The contracting bag assembly 20 allows the expandable ring to contract while the span of material 49 remains inflated to some extent out between the ends 48, so that when the ends come together they tend to pinch against the span of material. This keeps the expandable ring 46 from falling down the bag assembly 12 when the bag assembly has been contracted.

The circumference or breadth of the outer bag 31 is less than that of inner bag 30. The outer bag 31 is fabricated from a net-like material such as open mesh raschel knit tricot polyester or nylon, which forms a network of openings throughout the outer bag structure, thereby forming air passageways throughout the bag structure. By contrast, the inner bag 30 is fabricated from woven nylon such as woven filament nylon or polyester with an air porosity such as 1.5 to 2.5 cubic feet per minute per square foot of material, which is less pervious to the passage of air and steam than the net material of outer bag 31.

Figure 5:
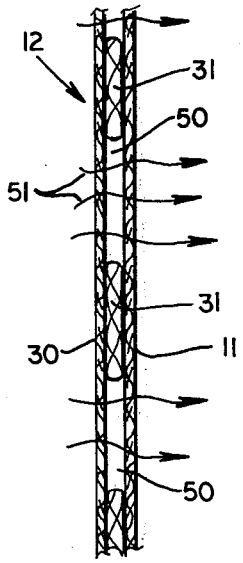
FIG. 5 is a detail edge cross sectional view of the garment presser bag assembly and the garment draped thereon, with the bag assembly inflated and expanded into engagement with the garment.

As illustrated in FIG. 5, when the inner bag 30 is expanded by inflation due to steam or air under pressure, it moves into engagement with the outer bag 31. The areas of contact between inner bag 30 and outer bag 31 tend to form a restriction to the flow of air and steam, but the network of openings 50 throughout outer bag 31 form no blockage and the air and steam are able to move through the inner and outer bags as indicated by the flow arrows 51. The garment material 11 is located outside the net-like material of outer bag 31, and those areas of contact between the net material of outer bag 31 with the garment material 11 also tend to form a restriction with respect to the passage of steam and air; however, the openings 50 in the net-like outer bag material do not tend to form a flow restriction seal with the garment and the steam and air moving the garment in the vicinity of each opening 50 is not blocked. It will be noted that the net-like material of the outer bag 31 tends to keep the inner bag 30 and the garment 11 separated so that an air flow seal will not be formed between the inner bag and the garment. Thus, a network of air passages is maintained throughout the areas of contact of the garment 11 with the garment presser bag assembly 12.

When the inner bag 30 is inflated it expands into contact with the outer bag 31 which is of less breadth than the inner bag, and net material of the outer bag 31 permits the other bag to expand. The stretching and expansion of the outer bag 31 requires the outer bag to move or creep upwardly with respect to the inner bag 30, especially at the lower end of the outer bag. The presence of the expandable ring 45 in the hem 44 of outer bag 31 and the friction between the two bags tends to restrain longitudinal movement of the outer bag in an upward direction with respect to the inner bag, so that the outer bag and its expandable ring 45 tend to create an elastic effect in containing the expansion of the bag assembly. Also, expandable ring 45 requires the lower edge of the outer bag to move or creep on the inner bag in a substantially uniform manner, and acts like an annular weight to hold the lower hem of the outer bag down and to keep the outer bag in an approximately cylindrical configuration until expanded. Thus, expandable ring 45 functions as a stablizing element for the bag assembly. Moreover, as the outer bag stretches when it is inflated by the larger inner bag it controls the expansion and shape of the overall bag assembly. As the bag assembly expands outwardly into contact with a garment, it also tends to expand the garment; however, as the fully inflated portions of the garment become tight about the bag, those portions add more constraint to the continued expansion of the bag assembly, whereupon the bag assembly no longer expands in that area of the fully expanded portion of the garment but continues to expand in other areas until constrained by the garment and/or the outer bag 31.

Moreover, expandable ring 46 functions in a like manner in that the indentation made by the ring in the expanding bags adds frictional contact between the bags and restrains longitudinal upward movement of the outer bag with respect to the inner bag. When the expandable ring 46 is positioned immediately adjacent the lower end of the garment 11, its restraining effect on the bag assembly as well as the restraining effect of the garment 11 on the bag assembly tend to maintain the upper portion of the bag assembly approximately within the proper breadth of the garment 11 so that the garment is not over expanded. The placement of the ring 46 immediately adjacent the lower edge of the garment 11 causes the ring and the lower edge of the garment to cooperate in controlling the portion of the bag assembly immediately below the garment 11.

When a garment such as a jacket with long sleeves is placed on the garment presser 10, U-shaped rods or "sleevers" 54 are inserted upwardly into each sleeve of the garment so as to shape the sleeves. This also tends to form the inside of the sleeves in a flat passageway of restricted dimensions, so that the air passing from inside the bag assembly 12 into the sleeves of the garment is restricted in its flow and does not freely escape to the atmosphere, and the steam and air in the bag assembly is maintained at a desired pressure for properly expanding and permeating the garment.

Figure 4:
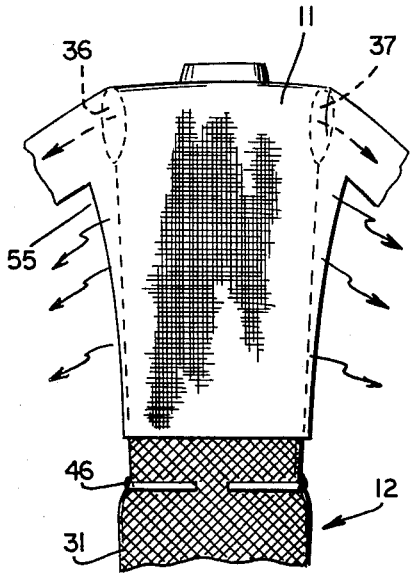
FIG. 4 is a partial view of the garment presser bag assembly and a shirt draped thereon.
Figure 6:
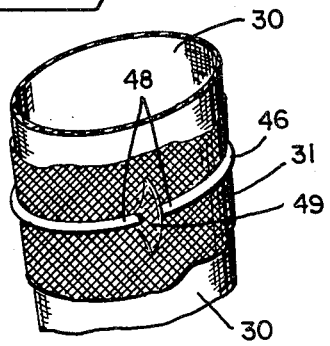
FIG. 6 is a detail illustration of the garment presser bag assembly, showing the restraining ring in its relaxed condition.

As illustrated in FIG. 4, when a garment 11 is placed on the bag assembly 12 which has portions thereof 55 that are larger in breadth than the breadth of outer bag 31, the bag assembly 12 tends to fill the garment 11 in those areas where the breadth of the bag is as big as the breadth of the garment, and the flow of air through the sleeve openings 36 and 37 tends to fill the remaining larger portion of the garment at 55. Thus, the upper enlarged portion of the garment will be expanded and premeated with steam and air.

While this invention has been described in detail with particular reference to preferred embodiments thereof, it will be understood that variations and modifications can be effected within the spirit and scope of the invention as described hereinbefore and as defined in the appended claims.

I claim:

1. A garment presser bag assembly comprising an inflatable inner bag of woven nylon material open at its lower end and defining at its upper end a central neck opening and arm openings on opposite sides of said neck opening, an outer bag of expandable net-like material defining a network of openings therethrough, said outer bag also being open at its lower end and inserted over said inner bag and defining at its upper end a central neck opening and arm openings on opposite sides of said neck opening, said inner bag and said outer bag being attached to each other about their neck openings and about their arm openings, said inner bag being of greater breadth than the normal breadth of said outer bag, whereby when a garment is draped over the bag assembly and the inner bag is inflated the inner bag expands to engage the outer bag and the outer bag tends to expand and ride upwardly about said inner bag until the outer bag inflates the garment, whereupon the constraint of the garment against the outer bag retards further expansion of the bag assembly.

2. The garment presser bag assembly of claim 1 and wherein said inner bag includes a hem structure at its lower end and drawstring in said hem structure for connecting the lower end of said inner bag to a support, and wherein said outer bag includes a hem structure at its lower end and a stabilizing element in said outer bag hem structure.

3. The garment pressure bag assembly of claim 2 and wherein said stabilizing element comprises an expandable C-shaped stay.

4. The garment presser bag assembly of claim 1 and further including an expandable ring element positioned about said outer bag of a circumference less than the circumference of said outer bag and movable vertically along the height of said outer bag.

5. The garment presser bag assembly of claim 4 and wherein said expandable ring element is approximately C-shaped with its ends movable away from each other as the inner bag is inflated and the inner and outer bags are expanded, and with its ends movable toward abutment with each other as the inner bag is deflated and the inner and outer bags are contracted, whereby the ends of said C-shaped expandabe ring element engage a portion of said outer bag therebetween upon contraction of said inner and outer bags whereby the C-shaped expandable ring element supports itself on said outer bag.

6. The garment presser bag assembly of claim 1 and further including a support frame, said inner and outer bags being draped about said support frame, said support frame and said inner bag being connected together at the lower end of said inner bag, and means for directing hot air through the lower opening of said inner bag to inflate said inner bag.

7. An inflatable and expandable garment presser bag assembly comprising an inflatable inner bag of substantially unstretchable woven material and defining an open lower end and an outer bag of stretchable net-like material defining a network of openings therethrough, said outer bag defining an open lower end and positioned about said inner bag with said outer bag movable along the length of said inner bag, said inner bag being of greater breadth than said outer bag, whereby the inner bag is inflatable and expandable to engage the outer bag and the outer bag tends to expand outwardly and ride up the inner bag as the outer bag is expanded outwardly, and when a garment is draped about said outer bag the net-like material of said outer bag restrains contact between said inner bag and the garment to prevent air seals from being formed between the inner bag and the garment.

8. The garment presser bag assembly of claim 7 wherein said inner bag defines at its end opposite to its open end a central neck opening and arm openings on opposite sides of said neck opening, and wherein said outer bag defines at its end opposite to its open end a central neck opening and arm openings on opposite sides of its said neck opening, said inner bag and said outer bag being connected together at their ends with the neck openings and arm openings.

9. The garment presser bag assembly of claim 7 and wherein said outer bag is shorter than said inner bag and includes at its open end a hem structure and an expandable ring member supported in said hem structure.

10. A garment presser bag assembly comprising an inflatable inner bag open at its lower end and an outer bag of expandable net-like material defining a network of openings therethrough, said outer bag also being open at its lower end and inserted over said inner bag, said outer bag being movable along the length of said inner bag, said inner bag being of greater breadth than the normal breadth of said outer bag, whereby when a garment is draped over the bag assembly and the inner bag is inflated the inner bag expands to engage the outer bag and the outer bag tends to expand and ride upwardly about said inner bag until the outer bag is contrained by the garment, whereupon the constraint of the garment against the outer bag retards further expansion of the bag assembly.

* * * * *